United States Patent [19]

Nakayama et al.

[11] 4,326,147

[45] Apr. 20, 1982

[54] SLOTTED SHADOW MASK HAVING APERTURES SPACED TO MINIMIZE MOIRÉ

[75] Inventors: Takeshi Nakayama, Tokyo; Takehiko Nishimoto, Kodaira; Machio Kawashima, Mobara; Kozi Takahashi, Mobara; Kuniharu Osakabe, Mobara, all of Japan

[73] Assignee: Hitachi, Ltd., Tokyo, Japan

[21] Appl. No.: 92,976

[22] Filed: Nov. 9, 1979

Related U.S. Application Data

[63] Continuation of Ser. No. 714,198, Aug. 13, 1976, abandoned.

[30] Foreign Application Priority Data

Aug. 18, 1975 [JP] Japan ..... 50-99534

[51] Int. Cl.[3] ..... H01J 29/07; H01J 29/32

[52] U.S. Cl. ..... 313/403

[58] Field of Search ..... 313/403, 714, 198

[56] References Cited

U.S. PATENT DOCUMENTS

| | | | |
|---|---|---|---|
| 3,766,419 | 10/1973 | Barbin | 313/403 |
| 3,777,204 | 12/1973 | Robbins et al. | 313/403 |
| 3,973,159 | 8/1976 | Barten | 313/403 |
| 3,973,965 | 8/1976 | Suzuki et al. | 313/403 |

FOREIGN PATENT DOCUMENTS

| | | | |
|---|---|---|---|
| 2012046 | 10/1970 | Fed. Rep. of Germany | 313/403 |

*Primary Examiner*—Robert Segal

*Attorney, Agent, or Firm*—Craig and Antonelli

[57] ABSTRACT

A color picture tube having a shadow mask is disclosed in which, with a view to making occurrence of moire imperceptible, electron beam transmissive apertures of the shadow mask are formed in such an array that a plurality of trains of the electron beam transmissive apertures each arrayed in the vertical direction with a pitch $P_y$ are juxtaposed to one another, wherein, assuming that the order of the harmonics is represented by n and m is an odd number smaller than 2n, there exist the relations $(n-0.5)P_l \leqq P_y \leqq (n+0.05)P_l$ and $(m-0.35)P_y/2n \leqq \Delta y \leqq (m+0.35)P_y/2n$ among the pitch $P_y$, pitch $P_l$ of scanning lines and vertical deviation $\Delta y$ between two adjacent apertures in the horizontal direction.

7 Claims, 23 Drawing Figures

Δy / PL
Py / PL
0
0.5
1.0
1.5
2.0
2.5
3.0
3.5
42
43
44
50
51
52
53
54
55
56
57
58
59
60
61
62
63
64
65
66
67

SLOTTED SHADOW MASK HAVING APERTURES SPACED TO MINIMIZE MOIRE

This is a continuation of application Ser. No. 714,198, filed Aug. 13, 1976.

The present invention relates in general to a color picture tube (CPT, color picture tube or color Braun tube) of a shadow mask type and in particular to a structure of the shadow mask for the color picture tube which comprises a plurality of electron beam transmissive apertures arrayed with a predetermined pitch in each of vertical rows, which vertical rows in turn are juxtaposed to one another in the horizontal direction.

In hitherto known color picture tubes or Braun tubes (hereinafter referred to simply as CPT), arrangement has generally been made such that the electron beams produced by three electron guns disposed in a linear or equilateral triangle configuration are, after having been deflected by a deflecting system, impinged onto phosphors of primary colors, i.e. red (R), green (G) and blue (B) as applied on the inner surface of the screen panel of CPT for the irradiation of the phosphor dots. The configuration of the phosphor dot corresponds to the shape of the electron beam transmissive aperture formed in the shadow mask. Mutual position of the phosphor dots for the three primary colors is determined by the positional relations among the three electron guns, apertures of the shadow mask and the phosphor plane. The shape of the aperture provided in the shadow mask may be in general classified into a circular and a vertically elongated rectangular form. In many conventional CPT's, combination of the three discrete electron guns arranged in an equilateral triangle configuration and the shadow mask provided with the circular apertures has been employed. Sately, CPT having a shadow mask provided with vertically elongated rectangular apertures tends to be increasingly used with an attempt to simplify the structure of the deflecting system and to improve the visual sharpness of the produced image.

In the case of the shadow mask provided with vertically elongated rectangular apertures for transmitting the electron beams, the apertures are arranged in the vertical direction with a predetermined pitch, as will be described in detail hereinafter. In other words, a vertical slit is divided by bridge portions with a periodical interval to form a vertical train of the apertures. Accordingly, when the phosphor screen is scanned with the electron beam in the horizontal direction through such shadow mask, fringes of bright and dark pattern of the scanning lines and shades of the bridge portions as projected onto the phosphor screen will cooperate under the beat effect to produce a fringe pattern of bright and dark portions having a great pitch, namely a moiré pattern, thereby to impair the visual quality of the produced image.

Various proposals have heretofore been made for reducing the moiré phonomenon. According to one attempt, the electron beam apertures which are positioned adjacent to each other along the horizontal direction are deviated from each other in the vertical direction by $1/\alpha$ of the vertical pitch ($\alpha$=an integer) of the apertures. The principle supporting such array of the aperture may be considered as starting from two view points according to one which the pitch of the moire fringes becomes greater as the pitch of the scanning lines approaches more to the vertical pitch of the appertures, whereby the moiré fringes are determined by the scanning line and the vertical deviation between the horizontally adjacent apertures, when such deviation is held small. In other words, the vertical deviation will bring about shadowed dark lines in the substantially horizontal direction. Accordingly, the moiré fringes may be made imperceptible by selecting the deviation at a smaller value, since the ratio between the pitch of the scanning lines and the deviation will then become greater. The other view point resides in that the horizontal fringes of the bright and dark pattern will not be produced when the integrated values of the transmittivities of the electron beam transmissive apertures remain same for each of the scanning lines. Accordingly, the moire can be reduced by adjusting properly the deviation and the width of the bridge portions.

However, the inventors of the present application have found after repeated experiments that, although the hitherto proposed means described above are effective for suppressing the moiré fringes appearing as the horizontal fringes of bright and dark potions, the moirés appearing in the oblique direction can not be made imperceptible by the above described conventional means alone.

It has been also proposed that the electron beam transmissive apertures are arrayed at random. This attempt however will be confronted with difficulties in the manufacturing of the shadow mask.

Accordingly, an important object of the present invention is to provide a color picture tube or CPT of a shadow mask type which scarcely suffers from the problem of the moiré phenomenon.

Another object of the invention is to provide an array of the electron beam transmissive apertures of the shadow mask for CPT which can reduce the influence of the moiré to a minimum.

Still another object of the invention is to provide a color CPT having a shadow mask provided with elongated rectangular apertures in which the moires in the oblique direction are considerably decreased. A further object of the invention is to provide a shadow mask which can be used in common in the CPT of the different types of television systems such as NTSC, PAL and SECAM which are different from one another in respect of the number of scanning lines for one field or frame of the image.

Taking the above objects into consideration, the present invention contemplates to prevent the visual system from being influenced by the pitch and phase of the beat components which are produced in dependence on the mutual product of the vertical through rate or transmittivity distribution pattern of the apertures formed in the shadow mask and the vertical luminance change pattern of the scanning lines by the electron beams and which will cause a moiré pattern. To this end, according to the invention, preselected ranges are established for the deviation $\Delta y$ of the aperture positions in the adjacent aperture rows or trains as well as for the ratio $P_y/P_l$ between the vertical pitch Py of the apertures of the shadow mask and the pitch $P_l$ of the scanning lines. In the case where only n-th harmonic (n=1, 2 or 3) of the vertical through rate or transmittivity pattern of the electron beam transmissive apertures provides a single influential factor, the preselected range for $\Delta y$ is determined as follows:

$$\frac{(m-0.35)P_y}{2n} \leqq \Delta y \leqq \frac{(m+0.35)P_y}{2n}$$

wherein m is a positive odd number smaller than 2n, and for the pitch ratio $P_y/P_l$, $$0.5 \leqq \frac{P_y}{P_l} \leqq 0.88 \text{ or } 1.17 \leqq \frac{P_y}{P_l} < 1.50, \text{ when } n = 1,$$

$$1.50 \leqq \frac{P_y}{P_l} \leqq 1.75 \text{ or } 2.33 \leqq \frac{P_y}{P_l} < 2.50, \text{ when } n = 2, \text{ and}$$

$$2.50 \leqq \frac{P_y}{P_l} \leqq 2.63, \text{ when } n = 3.$$

In the case where the two harmonics provide simultaneously influential factors, $$1.45 \leqq \frac{P_y}{P_l} \leqq 1.56 \text{ and that} \quad \text{(a)}$$

$0.6625\ P_y \leqq \Delta y \leqq 0.675\ P_y$ or $0.325\ P_y \leqq \Delta y \leqq 0.3375\ P_y$, when n=1 and 2, and $$2.41 \leqq \frac{P_y}{P_l} \leqq 2.61 \text{ and that} \quad \text{(b)}$$

$0.1625\ P_y \leqq \Delta y \leqq 0.225\ P_y$ or $0.775\ P_y \leqq \Delta y \leqq 0.8375\ P_y$ when n=2 and 3.

Of course, the quantities $\Delta y$ and $P_y/P_l$ will be varied within the above-established ranges in dependence on the scanning systems and the number of scanning lines as actually employed.

The above and other objects, features and advantages of the invention will become more apparent from the following detailed description taken in conjunction with the accompanying drawings, in which.

Figure 7A:
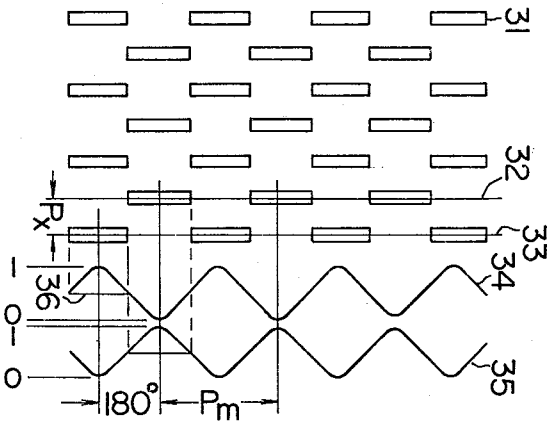
Figure 7B:
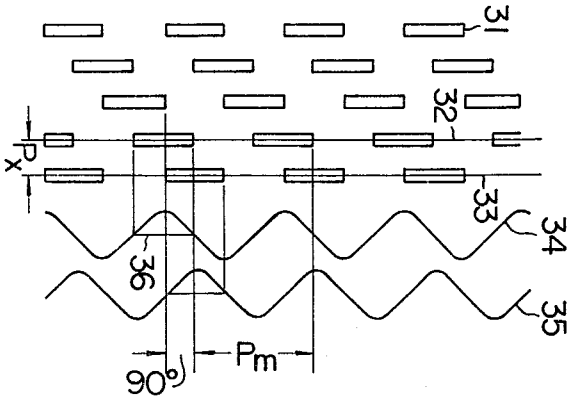
Figure 8:
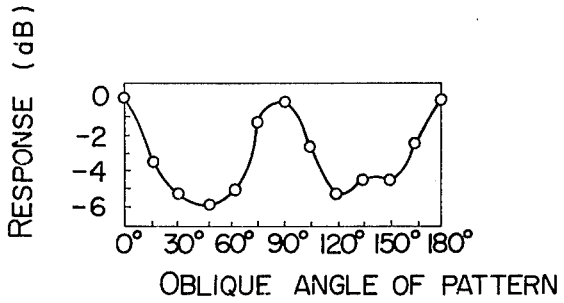
Figure 9:
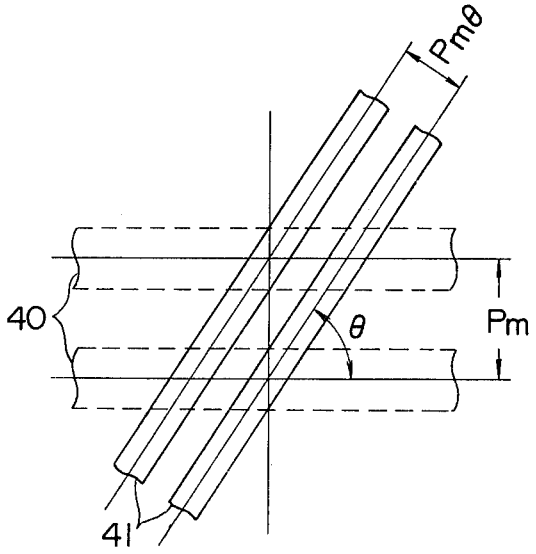
Figure 10:
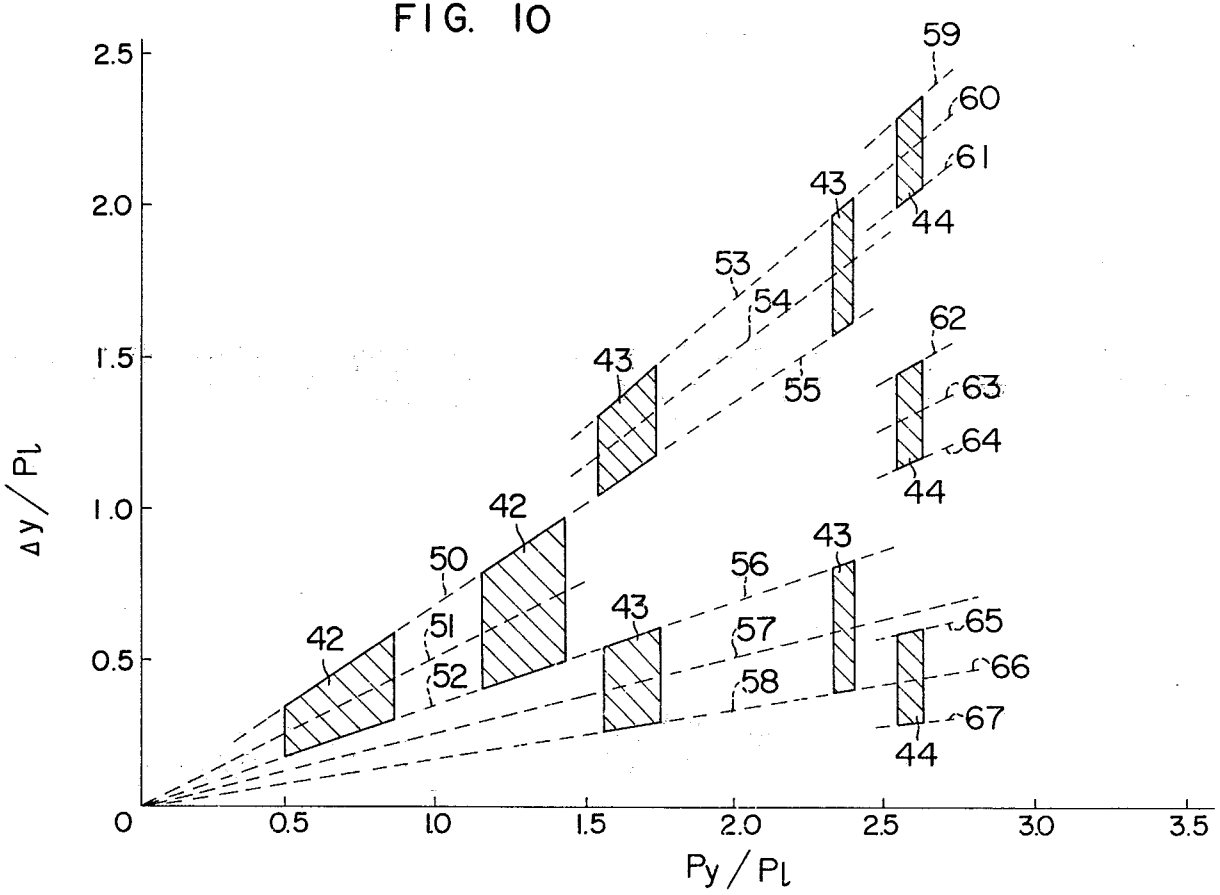
Figure 13:
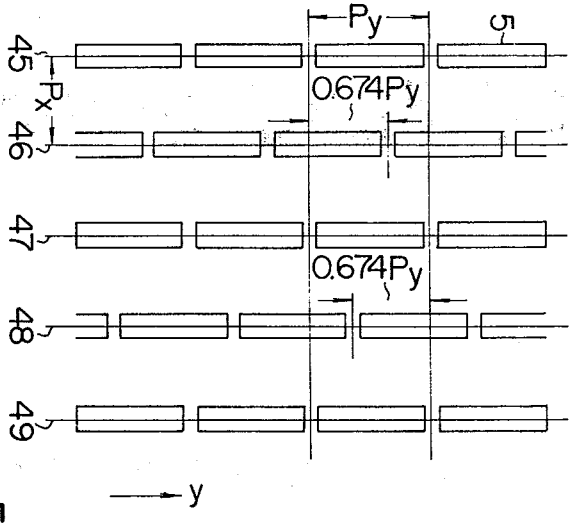
Figure 19:
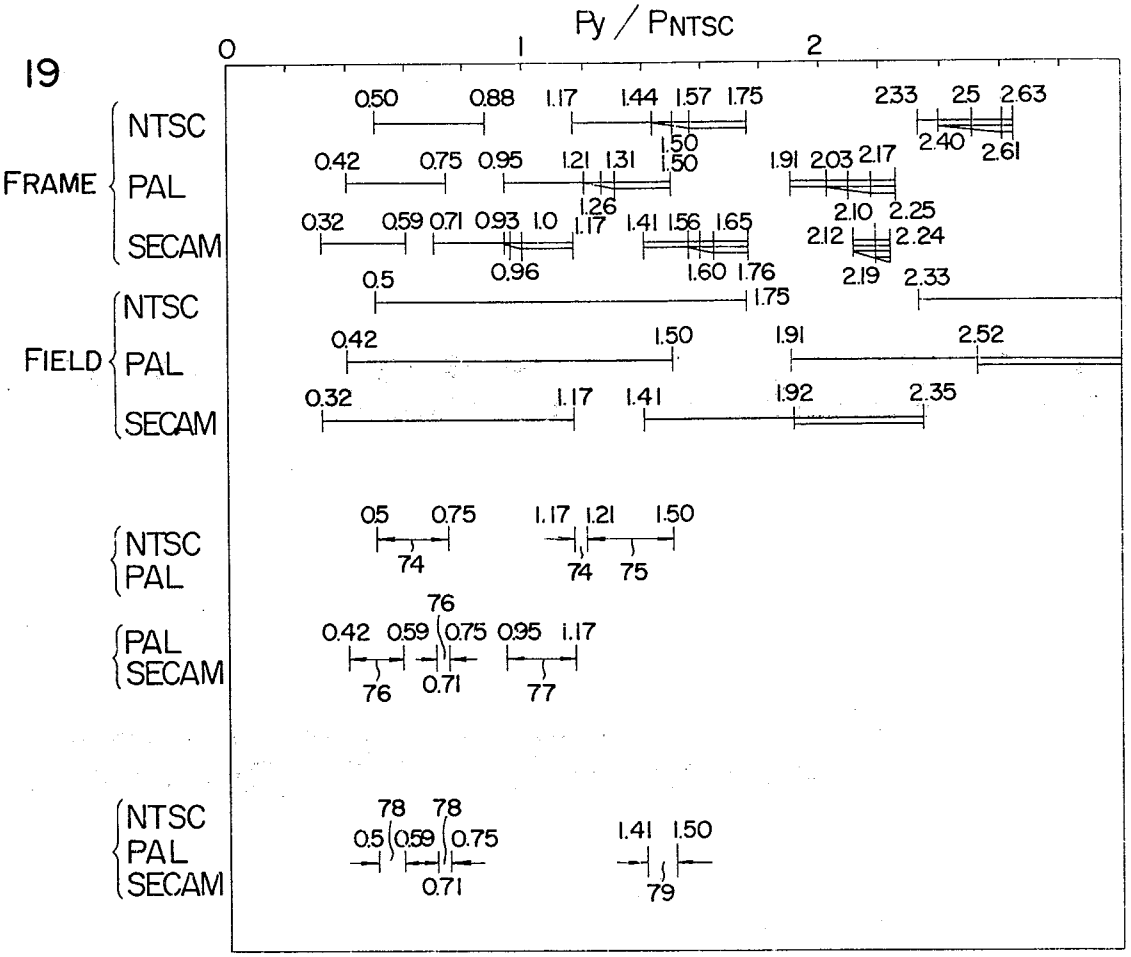
Figure 20A:
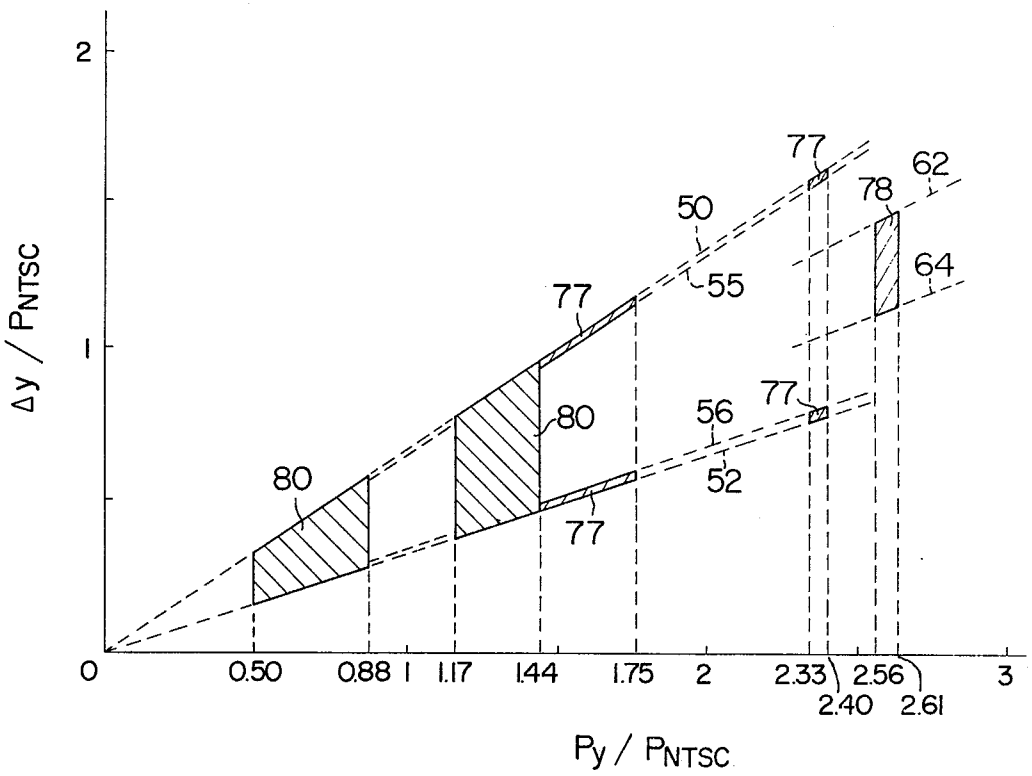
Figure 20B:
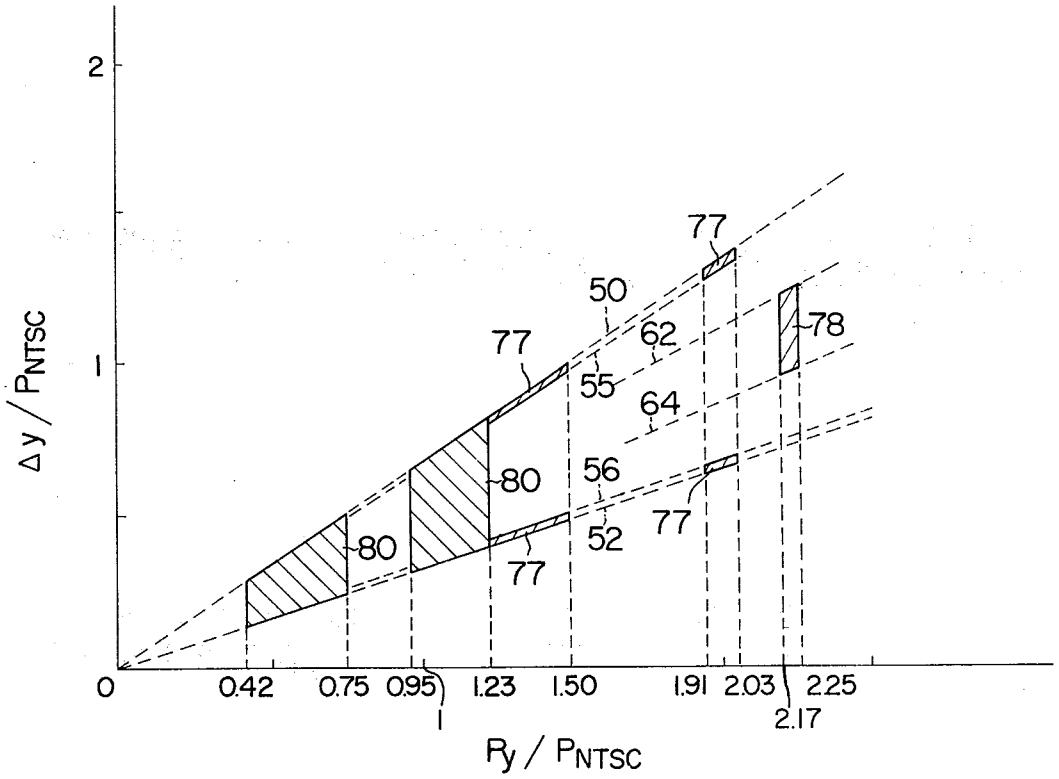
Figure 20C:
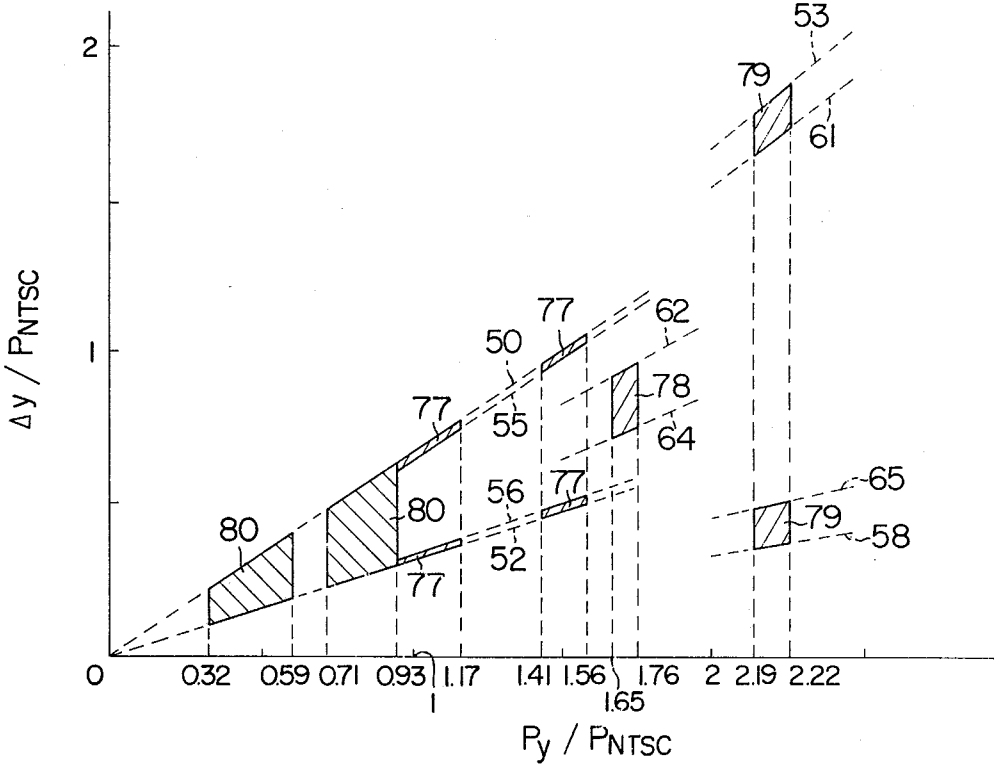

FIGS. 7A and 7B graphically show distributions of moire patterns;

FIG. 8 graphically shows a relation between the inclination of a moiré pattern and the visual response;

FIG. 9 illustrates a relation between the angle and pitch $P_m$ of a moiré pattern;

FIG. 10 illustrates graphically relations according to this invention between the vertical pitch $P_y$ and the positional deviation $\Delta y$ of the apertures in the adjacent vertical aperture rows;

FIGS. 11, 12, 13 and 16 are enlarged fragmental plan views showing shadow masks according to embodiments of the invention;

FIGS. 14, 15, 17 and 18 show moiré patterns to illustrate operations of the shadow masks shown in FIGS. 11, 12, 13 and 16;

FIG. 19 illustrates conditions under which the shadow mask shown in FIG. 13 is employed for different scanning systems; and FIGS. 20A, 20B and 20C illustrate relations between n, $\Delta y$, $P_y$ and m under which the shadow mask shown in FIG. 13 can be employed in NTSC, PAL and SECAM color television systems, respectively.

Figure 1:
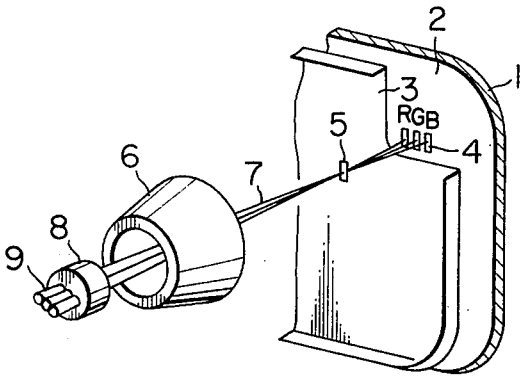
FIG. 1 PRIOR ART
FIG. 1 is a pictorial perspective view showing a main portion of a shadow mask type CPT to which the present invention is applied.

Referring to FIG. 1 which shows schematically a main portion of a shadow mask type CPT including a shadow mask provided with vertically elongated rectangular apertures 5 for the transmission of electron beams therethrough, reference numeral 8 denotes a tri-electron gun assembly which is composed of three individual electron guns 9 disposed in a linear array. Electron beams 7 emitted from the electron gun unit 8 are deflected by a magnetic field produced by a deflection system 6 and thereafter land on phosphor dots 4 of three primary colors, i.e. red, green and blue applied on the inner surface 2 (hereinafter referred to also as screen plane) of a face plate 1 after having passed through the electron beam transmissive aperture 5 (hereinafter referred to simply as aperture). In this connection, the geometrical configuration of the phosphor dot 4 corresponds to that of the apertures 5, while the mutual positional relation among three phosphor dots 4 of the primary colors illuminated by three electron beams 7 corresponds to the arrangement of the three electron guns 6.

Figure 2:
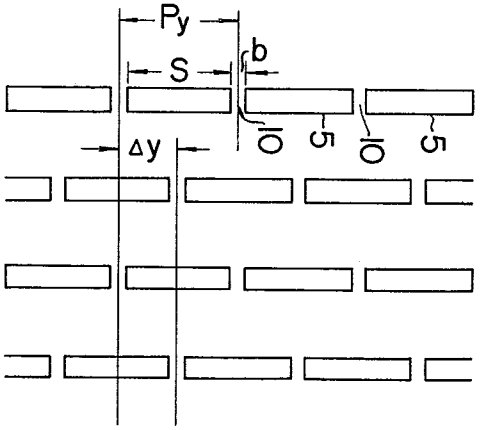
FIG. 2 PRIOR ART
FIG. 2 is an enlarged fragmental view of the shadow mask showing an arrangement or array of electron beam transmissive apertures formed in the shadow mask.

Referring to FIG. 2 which shows a portion of the shadow mask 3 in an enlarged plan view, vertically elongated apertures 5 are vertically isolated from one another with a vertical pitch $P_y$ by bridge portions or sections 10 each having a width b. Every aperture 5 is vertically offset from the horizontally adjacent one for a deviation or aberration $\Delta y$. Symbol S represents the length of the aperture 5 in the vertical direction.

Next, the reason why the moiré is caused to take place will be described. When a television image is to be displayed on the screen plane 2, the latter is scanned horizontally by the electron beams 7, whereby horizontal fringes of bright and dark portions are produced by the scanning lines of the electron beams on the screen plane 2. On the other hand, shades of bridge portions 10 provided with the pitch $P_y$ are projected on the screen plane 2 at a predetermined periodical interval. Thus, the dark portions of the fringes produced by the scanning lines and the shades of the bridge sections cooperate to produce a beat containing bright and dark portions with a greater pitch. Such beat is referred to as moiré. The moiré is of course observed on the screen plane. For convenience' sake of description, however, the scanning lines had better be considered as existing on the shadow mask, since the maskings of the electron beams 7 through the shadow mask 3 corresponds to the poriodical maskings of a part of the scanning lines in the vertical direction. In this connection, it is to be noted that the vertical pitch $P_y$ of the apertures to formed in the shadow mask is enlarged about 5% when projected on the screen plane 2. Accordingly, it is necessary to regard that the pitch of the scanning lines on the shadow mask 3 is contracted about 5%, when the pitch of the scanning lines on the shadow mask is in question. In any case, however, the ratio between the pitch of the scanning lines and that of the apertures of the shadow mask remains unchanged. In the following description, it is assumed that the scanning lines are present on the shadow mask 3.

Now, the principle of the invention will be described.

Figure 3:
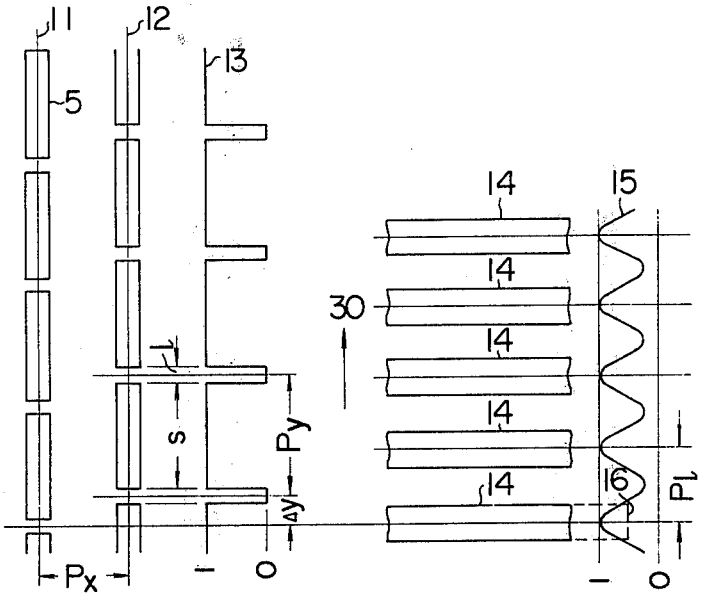
FIG. 3 illustrates diagramatically a relation between the aperture rows or trains and the scanning electron beam.

FIG. 3 shows graphically the relation between the apertures 5 of the shadow mask 3 and the scanning lines 14 together with respective profiles or patterns 13 and 15. In more particular, reference numerals 11 and 12 denote rows or trains of apertures located adjacent to each other, while the numeral 13 denotes the transmittivity or through rate pattern $g_s(y)$ of the electron beams on the assumption that the whole aperture row 12 is irradiated by the electron beams. The curve 15 on the other hand represents the vertical luminance change pattern $g_l(y)$ of the electron beams producing the associated scanning lines. These patterns or profiles may be considered in term of a wave form and then the luminance change pattern $g_l(y)$ may be well approximated by a sine wave.

Accordingly, the vertical luminance change wave form g(y) in he two-dimensional pattern of the intensity distribution of the electron beams can be expressed by using the above wave forms $g_s(y)$ and $g_l(y)$ as follows:

$$g(y)=g_s(y)\cdot g_l(y) \tag{1}$$

The pattern $g_s(y)$ is given by $$g_s(y) = B_o + \sum_{n=1}^{\infty} B_n \cos \omega_s (y - \Delta y) \tag{2}$$

wherein $$\omega_s = 2\pi\mu_p \tag{3}$$

and $$\mu_p = \frac{1}{P_y} \tag{4}$$

The pattern or wave form $g_l(y)$ can in general be expressed in a similar form as the formula (2). However, by approximating the luminance change or variation to the sine wave, the wave form $g_l(y)$ can be expressed by the following formula.

$$g_l(y)=B_l+A_l \cos \omega_l y \tag{5}$$

wherein $A_l$ represents the luminance modulation factor of the scanning line, and $\omega_l$ is given by $$\omega_l=2\pi\mu_l \tag{6}$$

$$\mu_l = \frac{1}{P_l} \tag{7}$$

Thus, the vertical luminance change pattern or wave form g(y) is a product of the formulae (2) and (5). Since the equation (2) is an orthogonal function, the individual terms thereof may be processed separately. When a function g(y) with respect to the n-th harmonic component of $g_s(y)$ is represented by $g_n(y)$, the latter can be expressed as follows:

$$g_n(y) = [B_o + B_n \cos n\omega_s(y - \Delta y)](B_l + A_l \cos \omega_l y) \tag{8}$$

$$= B_oB_l + \frac{B_nA_l}{2} \cos\left[2\pi\left(\frac{n}{P_y} - \frac{1}{P_l}\right) y - \frac{2n\pi\,\Delta y}{P_y}\right]$$

-continued $$+ B_lB_n \cos \frac{2n\pi}{P_y}(y - \Delta y) + B_oA_l \cos \frac{2\pi}{P_l} y$$

$$+ \frac{B_nA_l}{2} \cos\left[2\pi\left(\frac{n}{P_y} + \frac{1}{P_l}\right) y - \frac{2n\pi\,\Delta y}{P_y}\right]$$

In the above equation (8), the underlined term represents the moiré component. If the pitch of moiré is represented by $P_m$, the phase difference of the moiré corresponding to the deviation $\Delta y$ between the aperture rows is represented by $\phi_m$, and the luminance modulation factor is represented by $M_m$, then, these quantities are given by the following expressions:

$$P_m = \left|\frac{P_yP_l}{nP_l - P_y}\right| \tag{9}$$

$$\phi_m = \frac{2n\pi\,\Delta y}{P_y} \tag{10}$$

$$M_m = \frac{B_oA_l}{2B_oB_l} \tag{11}$$

In the first place, the pitch $P_m$ of the moire produced on the aperture rows will be discussed.

Figure 4:
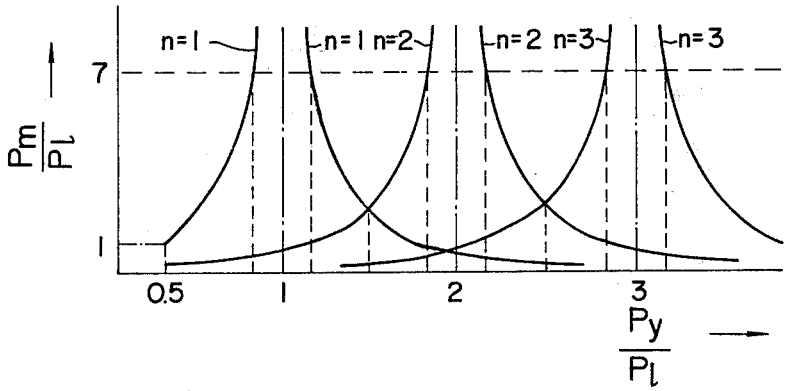
FIG. 4 illustrates graphically a relation between the pitch of moiré and the pitch of the apertures.

FIG. 4 graphically represents the formula (9). It should be noted that $P_m$ and $P_y$ taken along the ordinate and the abscissa, respectively, are standardized by the pitch $P_l$ of the scanning lines in form of $P_m/P_l$ and $P_y/P_l$, so that the discussion may be made independently from the screen size of CPT. In FIG. 4, the curves identified by n=1, n=2 and n=3 represent the pitches $P_m$ of the moirés caused by the beats between the luminance wave form 15 and the first (fundamental), second and third harmonics (hereinafter referred to as harmonics) of the aperture trasmittivity pattern 13.

FIGS. 7A and 7B show spatial patterns of the moiré in partial enlarged views. In these figures, reference numeral 31 denotes bright portions of the moiré on the screen plane. Although phosphor dots of three primary colors, i.e. red, green and blue on the screen plane are horizontally aligned and give forth light in practice, the figures show the light emission pattern of one type phosphor dots such as that of the green phosphor dots having the greatest luminance with a view to facilitating the indication of the correspondences between the apertures of the shadow mask and the phosphor dots on the screen plane. It is also assumed that the bright portions 31 of the moiré show a half-width 36 of the vertical luminance change pattern or wave form 34 of the moiré on the phosphor dot row 33. If the pitches of the moiré wave forms 34 and 35 on the phorphor dot rows 32 and 33 are represented by $P_m$ and the wave forms have a phase difference of 180° therebetween, then, the two-dimensional patterns of the moirés will be such as shown in FIG. 7A. It can be seen that no horizontal fringes are produced. Besides, the presence of the oblique patterns will not be perceived, since the oblique angles of the rightwardly rising pattern and the leftwardly rising pattern are equal to each other. On the other hand, when the phase difference of 180° becomes remarkably decreased to 90°, for example, the oblique patterns will become perceptible as shown in FIG. 7B. At the phase difference near zero, the horizontal fringe pattern will become remarkable. These two-dimensional patterns of the moiré do not necessarily correspond with the aperture transmittivity pattern of the shadow mask such as shown in FIG. 2. This is because the moiré will be varied in dependence on the order of the harmonics which is prominent in the vertical aperture transmittivity pattern or wave form shown in FIG. 3. A little change in the phase difference and hence in the deviation $\Delta y$ will provide substantially no significant influence.

In view of the foregoing discussion, the invention proposes to select the vertical pitch $P_y$ of the apertures 5 provided in the shadow mask and the deviation or aberration $\Delta y$ in such ranges in which the vertical luminance change patterns or wave forms of the moirés produced by the horizontally adjacent trains of apertures 5 become out of phase for about 180° or $m \times 180°$ (m=odd number) relative to each other and the pitch $P_m$ of the luminance change pattern of the moiré remains smaller than a predetermined value, thereby to make the moire imperceptible.

Next, description will be made on the limit of the allowable or permissible pitch of the moiré.

At first, in the case where the moiré due to the single n-th harmonic component becomes a matter of question, the following relation (12) can be determined starting from the fact that pitch due to the n-th harmonic is greater than that due to the (n±1)-th harmonics.

$$(n-0.5)P_l \leqq P_y \leqq (n+0.5)P_l \tag{12}$$

Therefore, $$\frac{P_y}{P_l} - 0.5 \leqq n \leqq \frac{P_y}{P_l} + 0.5 \tag{12a}$$

It has been experimentally found that the upper limit of the permissible pitch of the moire due to the single n-th harmonic may be defined by the period (or pitch) of the upper limit frequency of the video signal as displayed on the image screen of CPT and should not exceed the upper limit frequency. For example, in the case of NTSC color television system, the subcarrier for chrominance signal has a frequency of 3.58 MHz and the luminance signal is therefore at a lower band. Accordingly, the frequency of 3.6 MHz may be employed as the upper limit. The pitch of the displayed image corresponding to the signal of this frequency is about 3.5 in term of the pitch of the scanning lines. Since the phase difference between the moirés produced by the horizontally adjacent apertures is selected about 180° according to the invention as hereinafter described, the pitch of the horizontal fringes of the moiré will become effectively equal to $P_m/2$. Accordingly, the upper limit of the allowable pitch of the moiré is given as follows:

$$\frac{P_m}{P_l} \leqq 7.0 \tag{13}$$

Therefore, the following condition has to be satisfied.

$$\frac{P_y}{P_l} \leqq \frac{7}{8} n \quad \text{or} \quad \frac{P_y}{P_l} \geqq \frac{7}{6} n \tag{14}$$

In this manner, when only the pitch of the moire is in question, it is sufficient to establish the ranges for n, $P_y$ and $P_l$ so that the conditions (12) and (14) are satisfied.

However, where $P_y \approx (n \pm 0.5)P_l$, the pitch of the moiré due to the (n±1)-th harmonics will become also remarkable in addition to the one caused by the n-th harmonic. Under such situation, the moire can not be made imperceptible even if the phase difference of the moiré due to the horizontally adjacent apertures of the shadow mask is selected at 180° in respect of the n-th harmonic, since the above conditions (12) and (14) can not be satisfied for the (n±1)-th harmonics.

Accordingly, when the (n±1)-th harmonics have to be also taken into consideration, a region in the vicinity of $P_y \approx (n \pm 0.5)P_l$ must be excluded from the range of the practical pitch $P_y$ of the apertures which can be determined from the formulae (12) and (14).

The range of the pitch $P_y$ in consideration of the influence of the (n±1)-th harmonics may be established simply by determining n and $\Delta y$ for the region of $P_y$ in which the moire due to the n-th harmonic of the aperture transmittivity pattern or wave form 13 is obviously prominent as compared with the moiré due to the (n±1)-th harmonics. Such region may be established in the range of the visual response greater than 6 dB which can be determined by the pitch $P_m$ on the ground described hereinafter.

The visible occurrence of the moiré fringes depends on the moiré pitch $P_m$ and the luminance modulation factor $M_m$ of the moiré fringes, if the viewing distance is constant. However, when the ratio of the length of the pitch $$\frac{S}{P_y} = 0.9 \tag{15}$$

which approximately satisfies the practical conditions is selected for the transmittivity or through-rate pattern 13 of the vertically elongated rectangular apertures 5 of the shadow mask, then, in the expressions (2) and (12), it becomes as follows.

$B_1 = 0.219$, $B_2 = 0.208$, $B_3 = 0.191$, $B_4 = 0.168$, and $B_5 = 0.142$

Figure 5:
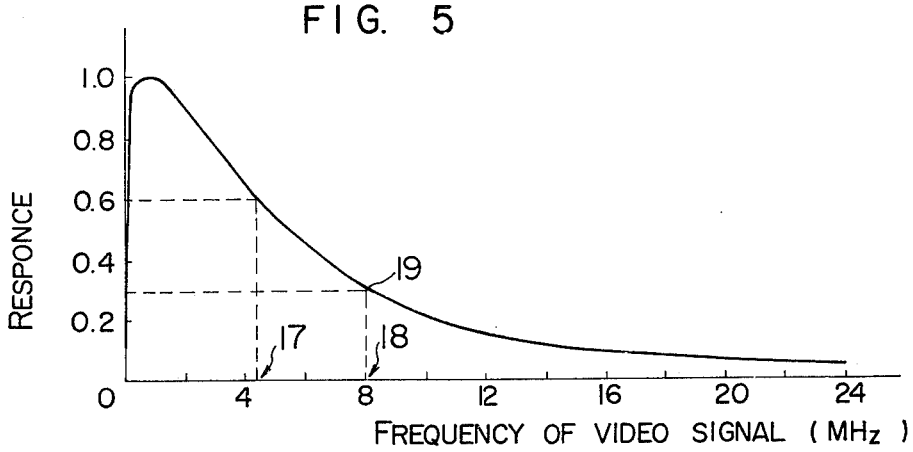
FIG. 5 illustrates graphically a relation between the visual response and the frequency of video signal.
Figure 6:
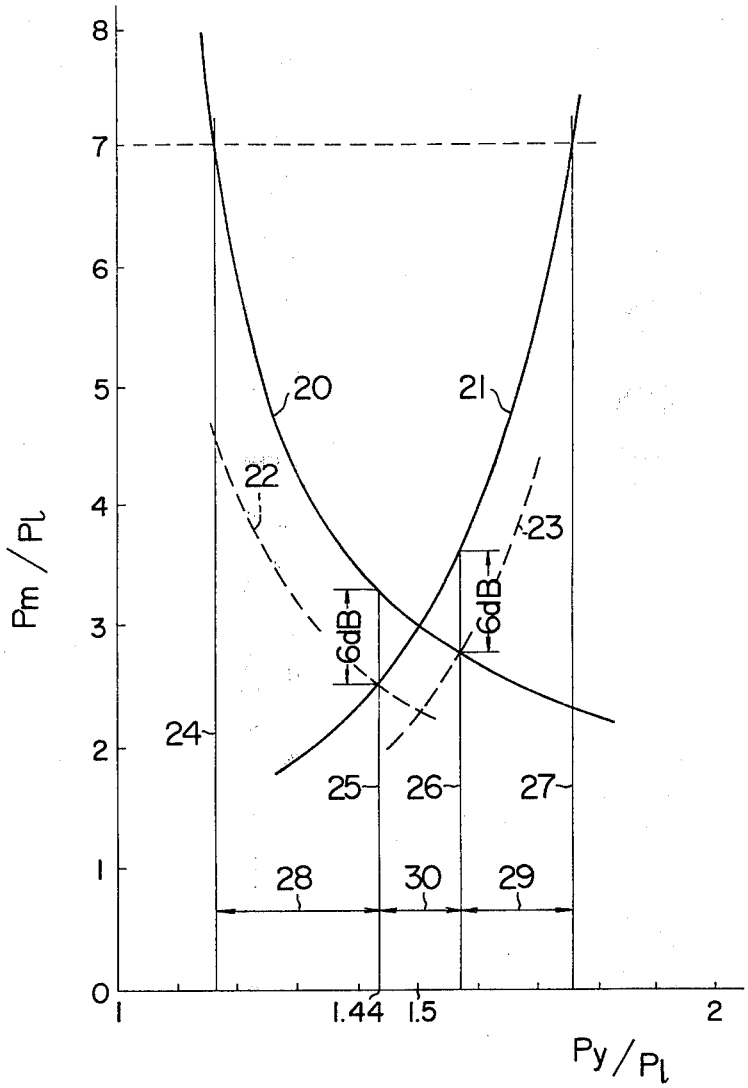
FIG. 6 is an enlarged fragmental diagram of FIG. 4.

It will be seen that the luminance modulation factor $M_m$ undergoes no greater variation than about 12 or 13%, even when n changes about ±1. In other words, the visible occurrence of the moiré pattern due to the luminance modulation factor $M_m$ is scarcely influenced by the orders of the harmonics. Next, examination will be made on the influence of the moiré pitch $P_m$ to the perceptibility of the moiré with the luminance modulation factor $M_m$ assumed constant. The perceptibility of the moiré can be represented by the frequency response of the visual system, as is shown in FIG. 5. In this figure, the curve 19 illustrates the response representative of the relative sensitivity of the visual system taken as a function of the video frequency at which a sine wave is visually displayed on the screen of a 20 inch type CPT and observed with a viewing distance 2 H wherein H represents the height of the image screen. Referring to FIG. 5, it will be seen that when the sine wave of the frequency indicated by an arrow 18 is displayed with a constant luminance modulation, the response of the visual system is decreased to a half of the response level attained at the display of the sine wave having the frequency designated by an arrow 17 with the same constant luminance modulation. This means that, in order to attain the same response at the frequency denoted by 18 as at the frequency denoted by the arrow 17, the luminance modulation must be twice as high as that of the video signal at the latter frequency. When this condition is selected as the reference for the visual prominence of the moiré upon the variation of the moiré pitch, the aforementioned range in which the n-th harmonic of the aperture transmittivity pattern or wave form 13 is predominant over the moire caused by the (n±1)-th harmonics can be easily determined. FIG. 6 shows a portion of FIG. 4 in the region $1 \leqq P_y/P_l \leqq 2$ in an enlarged scale and illustrates how to determine the regions corresponding to the values of n. In the figure, the curve 20 represents the relation between $P_y$ and $P_m$ defined by the formula (9) when n is equal to 1. The curve 21 represents the relation between $P_y$ and $P_m$ when n=2. The curve 22 represents $P_m$ for which the response of the visual system is lower than the case represented by the curve 20 for 6 dB. If the value of $P_y$ at the point of the abscissa intersected by the perpendicular 25 from the intersection of the curves 21 and 22 is given by $$P_y = 1.44\ P_l \tag{16}$$

then the moire due to the fundamental wave (n=1) is greater than the moiré caused by the second harmonic for 6 dB in term of the response of the visual system, and the influence of the moiré caused by the fundamental wave becomes predominant in the range smaller than the above point. The point at the abscissa intersected by the perpendicular line from the intersection between the upper limit value ($P_m/P_l=7.0$) of the moiré pitch determined by the formula (13) and the curve 20 represents the lower limit for the value of $P_y$ ($P_y=1.17\ P_l$) determined by the curve (20). The width represented by a segment 28 represents a part of the region of $P_y$ for the fundamental wave (n=1). In a similar manner, the segment 29 represents a part of the valid region of $P_y$ for the second harmonic (n=2). In the region represented by the segment 30, the occurrence of the moiré becomes substantially the same for the fundamental and the second harmonics (n=1, n=2).

As will be understood from the above discussion, the range to be established in view of the pitch $P_y$ may be in general classified into two regions: the first region (1) in which the moiré caused by the single n-th harmonic is taken into consideration, and the second region (2) in which the moire influenced simultaneously by plural harmonics of different n is to be considered, as is summarized in the following Tables I and II.

TABLE I

| n | $P_y/P_l$ Case (1) | $P_y/P_l$ Case (2) |
|---|---|---|
| 1 | 0.50–0.88 | 1.17–1.44 |
| 2 | 1.57–1.75 | 2.33–2.40 |
| 3 | 2.61–2.63 | |

TABLE II

| n | $P_y/P_l$ |
|---|---|
| 1 and 2 | 1.45–1.56 |

TABLE II-continued

| n | $P_y/P_l$ |
|---|---|
| 2 and 3 | 2.41–2.60 |

The lower limit value 0.5 for the case n=1 in the Table I is the value at which $P_m$ becomes equal to $P_l$. Selection of the moiré pitch at a value smaller than the one corresponding to the lower limit will not improve the image quality any further, only involving increased difficulty in the manufacture of the color CPT, since the scanning lines provide another influential factor.

Next, discussion will be made from the stand point of the phase difference of the moirés. As described hereinbefore in conjunction with FIGS. 7A and 7B, the phase difference $\phi_m$ of the moirés for the adjacent aperture rows should be 180° (=$\pi$) or approximations thereof. Thus, $$\phi_m = \frac{2n\pi\ \Delta y}{P_y} = \pi \tag{17}$$

Hence $$\Delta y = \frac{P_y}{2n} \tag{18}$$

However, the phase difference is not restricted to 180° (degree), but may take $m \cdot \pi$ (where m is an odd integer). Further, a predetermined range about $m \cdot \pi$ is also permissible. Namely, $$m\pi - \Delta\theta \leqq \frac{2n\pi\ \Delta y}{P_y} \leqq m\pi + \Delta\theta \tag{19}$$

Hence $$\frac{m - \frac{\Delta\theta}{\pi}}{2n} \cdot P_y \leqq \Delta y \leqq \frac{m + \frac{\Delta\theta}{\pi}}{2n} \cdot P_y \tag{20}$$

The angular span $\Delta\theta$ of 63° (degree) corresponds to 3 dB in the response of the visual system and 35% in the variation of $\Delta y$.

It has to be pointed out that the response of the visual system is not only varied as a function of the variation in the spatial frequency as illustrated in FIG. 5, but also depends on the oblique angle of the pattern as shown in FIG. 8. Assuming that the moiré fringes produced by the adjacent aperture rows or trains are in phase as shown in FIG. 9 and the pitch of the horizontal fringes having high bright portions 40 is represented by $P_m$, the moiré pattern can be converted into an oblique pattern 41 with an angle $\theta$ by varying the phase of the adjacent moiré waves. Then the pitch $P_{m\theta}$ of the oblique pattern intersecting the moire pattern of the pitch $P_m$ at an angle $\theta$ is decreased as expressed by $$P_{m\theta} = P_m \cos\theta \tag{21}$$

As a result, the response of the visual system will be reduced, as can be appreciated from the illustration in FIG. 5, whereby the moiré fringes become imperceptible. Further, it can be seen in FIG. 8 that the response is decreased in a direction having an oblique angle of $\theta$ other than 0° and 90°. In this manner, the effect of the oblique moiré pattern produced by the phase difference between the moiré waves due to the adjacent aperture rows may be represented by a sum of the decreases of two varieties in the response of the visual system.

As described hereinbefore, a definite difference will appear in the perceptibility of the moire for the variation of 6 dB in the response. However, at the variation of 3 dB, no substantial difference will occur in the perceptibility of the moire. The phase difference $\phi_m$ of the moire which will be obtained by changing $\Delta y$ for $\pm V\%$ from the mid-point given by equation (18) thereof can be expressed as follows:

$$\phi_m = 180^\circ \pm \left(\frac{18V}{10}\right) \text{ (degree)} \tag{22a}$$

Therefore, the phase difference $\phi_m$ will undergo a variation of 18° for a change of 10% in $\Delta y$. As mentioned previously, the phase difference showing a reduction of 3 dB in visual response is as follows.

$$\phi_m = 180^\circ \pm 63^\circ \tag{22b}$$

Referring again to the expression (20), since $2n > m$ and $$\frac{\Delta\theta}{\pi} = \frac{60^\circ}{180^\circ} = 0.35,$$

this expression may be rewritten as follows:

$$\left.\begin{array}{l} \dfrac{(m-0.35)P_y}{2n} \leqq \Delta y \leqq \dfrac{(m+0.35)P_y}{2n} \\ \text{wherein } m = 1, 3, 5 \\ \qquad 2n = 2, 4, 6 \\ \qquad m < 2n \end{array}\right\} \tag{23}$$

It will now be understood that the conditions for forming the array of the aperture rows in the shadow mask according to the principle of the invention can be fulfilled by selecting m, n, $P_y$, $P_l$ and $\Delta Y$ so that the conditions listed up in the Tables I and II as well as the expression (23) may be satisfied.

In more detail, in the case wherein the single n-th harmonic component is in question, the relations among $P_y$, n and $\Delta y$ are such as shown in FIG. 10. In the figure, the hatched areas 42 represent the regions in which the moiré due to the fundamental wave (n=1) is reduced, the hatched areas 43 represent the regions in which the moiré due to the second harmonic (n=2) is decreased, and the hatched areas 44 represent the regions in which the moiré due to the third harmonic (n=3) is reduced.

In FIG. 10, the upper and the lower limits of $P_y/P_l$ are determined on the basis of the values listed in the Table I. In the same figure, broken lines 50 to 67 correspond to the following equations.

$$\left.\begin{array}{l} 50:\ \Delta y/P_l = \dfrac{(1+0.35)}{2}\cdot P_y/P_l \\ 51:\ \Delta y/P_l = \tfrac{1}{2}\,P_y/P_l \\ 52:\ \Delta y/P_l = \dfrac{(1-0.35)}{2}\cdot P_y/P_l \\ 53:\ \Delta y/P_l = \dfrac{(3+0.35)}{4}\cdot P_y/P_l \\ 54:\ \Delta y/P_l = \tfrac{3}{4}\,P_y/P_l \end{array}\right\} \tag{24}$$

-continued $$\left.\begin{array}{l} 55:\ \Delta y/P_l = \dfrac{(3-0.35)}{4}\cdot P_y/P_l \\ 56:\ \Delta y/P_l = \dfrac{(1+0.35)}{4}\cdot P_y/P_l \\ 57:\ \Delta y/P_l = \tfrac{1}{4}\,P_y/P_l \\ 58:\ \Delta y/P_l = \dfrac{(1-0.35)}{4}\cdot P_y/P_l \\ 59:\ \Delta y/P_l = \dfrac{(5+0.35)}{6}\cdot P_y/P_l \end{array}\right|$$

$$\left.\begin{array}{l} 60:\ \Delta y/P_l = \tfrac{5}{6}\,P_y/P_l \\ 61:\ \Delta y/P_l = \dfrac{(5-0.35)}{6}\cdot P_y/P_l \\ 62:\ \Delta y/P_l = \dfrac{(3+0.35)}{6}\cdot P_y/P_l \\ 63:\ \Delta y/P_l = \tfrac{3}{6}\,P_y/P_l \end{array}\right|$$

$$\left.\begin{array}{l} 64:\ \Delta y/P_l = \dfrac{(3-0.35)}{6}\cdot P_y/P_l \\ 65:\ \Delta y/P_l = \dfrac{(1+0.35)}{6}\cdot P_y/P_l \\ 66:\ \Delta y/P_l = \tfrac{1}{6}\,P_y/P_l \\ 67:\ \Delta y/P_l = \dfrac{(1-0.35)}{6}\cdot P_y/P_l \end{array}\right\}$$

Next, description will be made on the conditions which are required for the imperceptibility of the moiré produced under the simultaneous influences of the harmonics of different orders. In this case, the regions or ranges in which harmonics of different orders provide simultaneously influential factors can be determined from the Table II and the expression (23).

For example, where n=1 and 2, the expression (23) can be rewritten as follows:

$$\left.\begin{array}{l} \dfrac{(1-0.35)}{2}P_y \leqq \Delta y \leqq \dfrac{(1+0.35)}{2}P_y \\ \text{and} \\ \dfrac{(1-0.35)}{4}P_y \leqq \Delta y \leqq \dfrac{(1+0.35)}{4}P_y \\ \text{or} \\ \dfrac{(3-0.35)}{4}P_y \leqq \Delta y \leqq \dfrac{(3+0.35)}{4}P_y \end{array}\right\} \tag{25}$$

Accordingly, $$\left.\begin{array}{l} 0.6625\,P_y \leqq \Delta y \leqq 0.675\,P_y \\ \text{or} \\ 0.325\,P_y \leqq \Delta y \leqq 0.3325\,P_y \end{array}\right\} \tag{26a}$$

In the case wherein n=2 and 3, $$\left.\begin{array}{l} 0.1625\,P_y \leqq \Delta y \leqq 0.225\,P_y \\ \text{or} \\ 0.775\,P_y \leqq \Delta y \leqq 0.8375\,P_y \end{array}\right\} \tag{26b}$$

Now, the invention will be described in detail in conjunction with practical embodiments.

Figure 11:
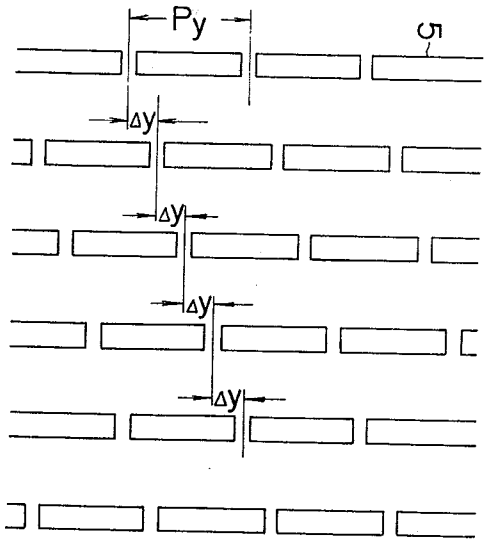

FIG. 11 shows a shadow mask which is designed for the application in which only a second harmonic gives rise to problem, and in which the deviation $\Delta y$ is maintained at a constant among any adjacent aperture rows. The numerical values for $P_y$ and $\Delta y$ are determined in consideration of the fact that the pitch $P_l$ of the scanning lines is in general different in dependence on the size of the image screen of CPT and that usually the vertical scanning size is selected greater than the height of the image screen for about 50%. For example, refer to Table III.

TABLE III

| Type | $P_l$ | | $P_y$ and $\Delta y$ Case (1) | $P_y$ and $\Delta y$ Case (2) |
|---|---|---|---|---|
| 14 | 0.428 | $P_y$ | 0.672–0.749 | 0.997–1.032 |
| | | $\Delta y$ | 0.168–0.187 | 0.249–0.258 |
| 16 | 0.494 | $P_y$ | 0.776–0.865 | 1.151–1.191 |
| | | $\Delta y$ | 0.194–0.216 | 0.288–0.298 |
| 18 | 0.556 | $P_y$ | 0.872–0.973 | 1.295–1.340 |
| | | $\Delta y$ | 0.218–0.243 | 0.324–0.335 |
| 20 | 0.617 | $P_y$ | 0.969–1.080 | 1.438–1.487 |
| | | $\Delta y$ | 0.242–0.270 | 0.359–0.372 |

(Unit: mm)

The values of $\Delta y$ and $P_y$ in the array of apertures at which the moiré pitch $P_m$ becomes dominant between the second harmonic (namely, n=2) of the aperture transmittivity pattern or wave form 13 and the scanning lines, can be determined from the Table III on the basis of the Table I. The numerical values listed up in the Table III are destined for the NTSC color television system in which 525 scanning lines are employed and for the case that m is equal to 1.

The value of $\Delta y$ may be varied about ±35% from the numerical values enumerated in the Table III. In the conjunction, the values for $\Delta y$ may be so selected that they fall within the limits determined by the equations (24) corresponding to the broken lines 53, 55, 56 and 58.

Figure 12:
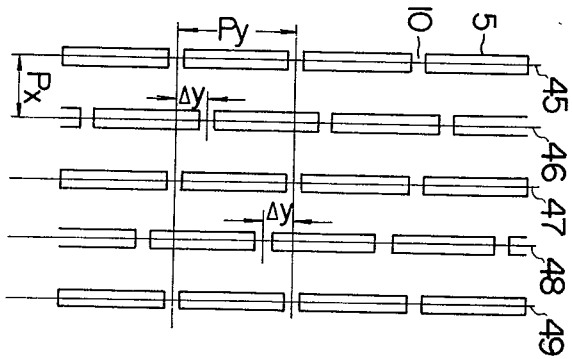

FIG. 12 shows an array of the apertures formed in the shadow mask for the case wherein a single moiré is produced by the second harmonic (i.e. n=2). When the bridge sections 10 are deviated for $\Delta y$ between the adjacent vertical aperture rows and if the amount of the deviation $\Delta y$ satisfies the equation (23), the phase difference $\phi_m$ of the moire for the second harmonic will lie in the range defined by the expression (22*b*).

When the sign of $\Delta y$ is changed for every even-numbered rows as shown in FIG. 12, the perceptibility of the moiré is reduced, since the bright and dark portions of the moiré will not extend uniformly in the horizontal direction.

Figure 14:
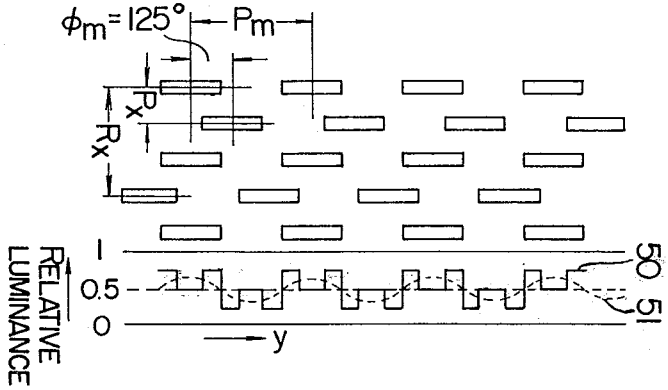
Figure 15:
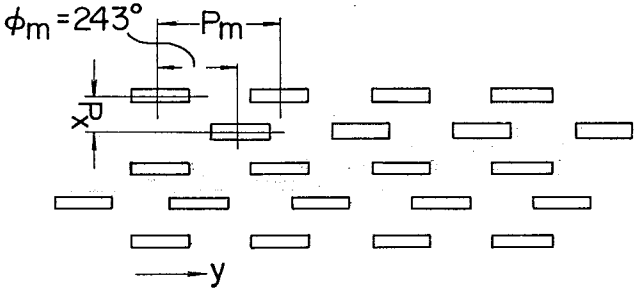

FIG. 13 shows the aperture array in which the moiré produced by two harmonics of n=1 and 2 has to be considered. $\Delta y$ is determined so as to fall within the range defined by the expression (24) for both the harmonics of n=1 and n=2. When $\Delta y$ is selected as 0.674 $P_y$ as shown in FIG. 13, V of the expression (22) takes the following value for the case wherein n=1:

$$V=+34.8\ (\%),$$

assuming that m=1. For the case wherein n=2, $$V=-30.4\ (\%)$$

assuming that m=3. The moiré pattern as produced for n=2 is shown in FIG. 14, and the pattern for n=1 will be such as shown in FIG. 15. In more particular, the apertures in the row 45 are offset upwardly for 0.674 $P_y$ relative to the apertures in the row 46. Accordingly, the phase difference $\phi_m$ of the moiré between the aperture rows 45 and 46 will be about 243° as calculated from the formula (23). In FIG. 15, the first row of the moiré waves is produced by the aperture row 45 shown in FIG. 13, the second row of the moiré waves is produced by the second aperture row 46 and so forth. The phase of the second moire row shown in FIG. 15 is delayed (upwardly displaced) for 243° relative to the first moiré row. The moiré waves in the first and the third rows are in phase, namely $\phi_m=0$, because of $\Delta y=0$ as is shown in FIG. 13. Since the aperture row 48 is deviated for $\Delta y=0.674\ P_y$ from the aperture row 47, the phase of the fourth moiré row leads (displaced downwardly) for 243° relative to the third moiré row. In the case wherein n=2, the value of V (=30.4%) is placed in the expression (22). Then, $$\phi_m=125°$$

The moiré pattern will be such as shown in FIG. 14. When the whole image screen is macroscopically observed, the horizontal fringes of the bright and dark portions caused by the moiré can be evaluated by integrating the moiré patterns at the respective aperture rows for a period $R_x$ (including the aperture rows 45 to 48 in FIG. 12) in the horizontal direction and determining the amplitude of the wave form produced by projecting the integrated moiré patterns onto the vertical axis as shown in FIG. 14. The integration wave form 50 shown in FIG. 14 results from the assumption that the bright portion of the moiré represented by the rectangular strip has a uniform brightness for convenience' sake of the description. However, since the bright portions show a half-width of sinusoidal moiré waves, the integration wave form 50 in FIG. 14 will in reality be more smooth with the amplitude being also decreased. The amplitude of the fundamental wave 51 of the integration wave form 50 corresponds to the luminance modulation factor of the horizontal fringes of the moire when observed macroscopically. Obviously, when $\phi_m=0$, the the luminance modulation factor of moire will be 100 (%). When $\phi_m=180°$, the latter is 0. When $\phi_m=180°\pm90°$, the luminance modulation factor will be 50 (%). In the aforementioned permissible range in which $\phi_m=180°\pm63°$, the luminance modulation factor will become smaller than 34 (%). As will be clearly understood when compared with FIG. 7A which employs the same $P_x$ and $P_m$ as in FIG. 14, the oblique moire pattern as obseved macroscopically is substantially the same as the case wherein $\phi_m=180°$ or varied in the imperceptible directin, since the bright portions are not aligned in an oblique straight line. Since this embodiment is useful either for n(=1) or n(=2), the boundary region between n=1 and n=2 can be continuously used. In other words, when $P_y$ is expressed in term of $P_l$ (pitch of the scanning lines), the range of 1.17 to 1.75 can be employed in a continuous manner.

Further, by inverting the sign of $\Delta y$ at the second and the fourth aperture rows as shown in FIG. 13, the horizontal positions of the bright and the dark portions of the moiré pattern are varied in dependence of the sign of $\Delta y$, whereby the uniform distribution of the bright and dark portions of the moiré in the horizontal direction can be prevented, thereby to make the moire more imperceptible.

Figure 16:
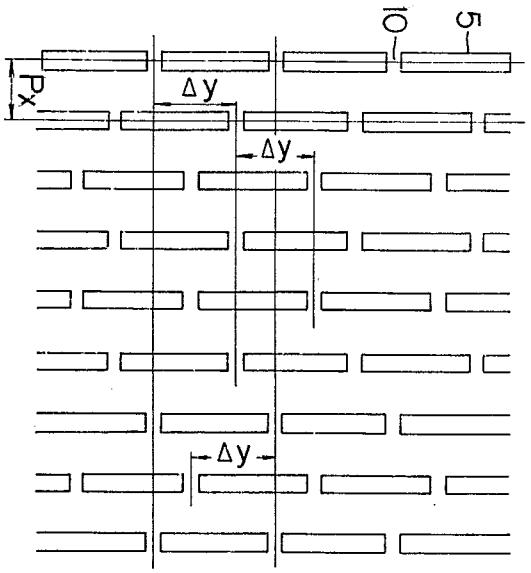

FIG. 16 shows another embodiment of the invention. If the upward deviation of $\Delta y$ is represented by $+\Delta y$, the array of the deviations of the apertures in the shadow mask shown in FIG. 16 is such that $+\Delta y$, $+\Delta y$, $-\Delta y$, $+\Delta y$, $-\Delta y$, $-\Delta y$, $-\Delta y$ and $+\Delta y$. The range of $\Delta y$ for both of n(=1) and n(=2) is determined by the equations (26*a*) and in the case wherein n=2 and 3, the range of $\Delta y$ is determined by the equations (26*b*).

Figure 17:
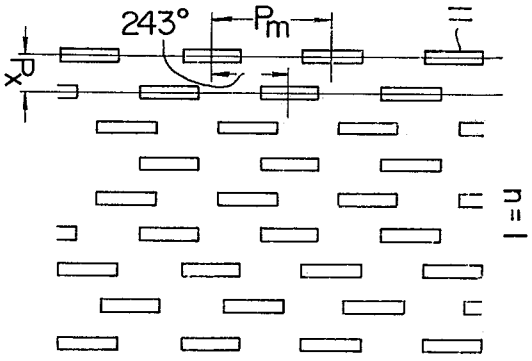
Figure 18:
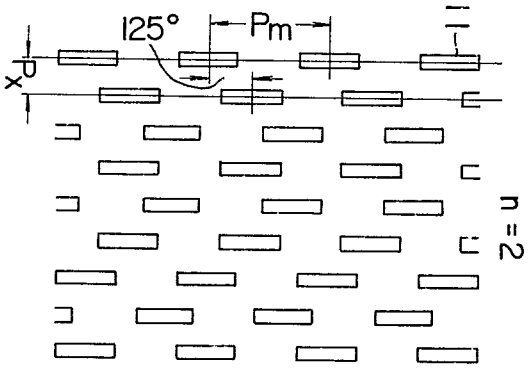

FIGS. 17 and 18 show moiré patterns, respectively, for the cases wherein n=1 and n=2 with $\Delta y$ selected equal to 0.674 $P_y$ as in the aforementioned embodiment.

In the array shown in FIG. 16, the moirés can be made imperceptible simultaneously for two different orders n. Further, since the bright and dark portions of the moiré are not aligned in the oblique or horizontal direction, the uneveness in the luminance distribution can be negligibly suppressed.

The above described embodiments of the shadow mask are useful in CPT of the type in which the video signals are interlaced. In the television receiver in which the scanning lines are interlaced at a ratio of 1:2, moiré caused by the scanning lines constituting one field will become an eyesore when eye or face or screen image is moved, even if the moiré is suppressed in consideration of the whole scanning lines for one frame. Since the number of the scanning lines for one field is a half of the scanning line number for one frame, it is necessary to reduce the moiré for both the field and the frame with n=1 for the former and n=2 for the latter. The same applies to the cases wherein n=3 for the frame and n=1 for the field as well as n=3 for the frame and n=2 for the field.

It has been experimentally found that the pitch $P_m$ of the moiré produced during one field may be twice as great as the one produced during one frame, so far as the phase $\phi_m$ of the moiré produced in the field falls within the range defined by the expression (22*b*). The permissible pitch of the moire in the field can be given by $$\frac{P_m}{P_l} \leqq 14 \tag{27}$$

Accordingly, $$\frac{P_y}{P_l} \leqq \frac{7}{4}n \text{ or } \frac{P_y}{P_l} \geqq \frac{7}{3}n \tag{27a}$$

In order that the moiré pitch in the field be imperceptible, for the case wherein $P_y/P_l \leqq 3$, there are required n=1 and $P_y/P_l \leqq 1.75$ or $P_y/P_l \geqq 2.33$. The order of the harmonic of the aperture transittivity pattern in question is the first order. When the moirés in the frame and the field are considered, values of n for the various ranges of $P_y/P_l$ are such as shown in Table IV.

TABLE IV

| Case | $P_y/P_l$ | Value of n to be considered in the frame | Value of n to be considered in the field |
|---|---|---|---|
| (1) | 0.50–0.88 or 1.17–1.44 | 1 | |
| (2) | 1.45–1.56 | 1 and 2 | 1 |
| (3) | 1.57–1.75 or 2.33–2.40 | 2 | |
| (4) | 2.41–2.60 | 2 or 3 | |
| (5) | 2.61–2.63 | 3 | |

As will be apparent from the Table IV, in the case (1), the moiré patterns for n(=1) are examined for both the frame and the field. In other cases (2) to (5), however, measure must be taken to make the moire imperceptible for two or more different values of n. To this end, the shadow mask shown in FIG. 13 may be employed for the cases (2) and (3). In the case (4) wherein moirés have to be negligible simultaneously for n(=1, 2 and 3), the present invention can not be advantageously applied. Under such circumstances, the invention may be applied for two different values of n with a boundary set at 2.5 of $P_y/P_l$ ratio. In the case (5), moirés for n(=3) and n(=1) are decreased. To this end, the following condition which can be derived from the expression (24) has to be satisfied. Namely, $$0.442\ P_y \leqq \Delta y \leqq 0.558\ P_y \tag{28}$$

The present invention may further be incarnated in a shadow mask which can be used in common for different scanning systems. At present, PAL (Phase Alternation by Line) television system and SECAM (Séquential á Mémoire) color television system are adopted in practice in addition to NTSC (National Television System Committee) system. If a single shadow mask can be employed in common in the CPT's for these systems, it will be a great advantage from the manufacturing viewpoint. Requirement imposed on such shadow mask resides in that the mask can be used in combination with different scanning systems without incurring any appreciable moirés.

Next, embodiments of the shadow mask which can be used in common for the different scanning systems and is effective for suppressing the occurrence of the moiré will be described.

In the case of PAL and SECAM systems, the permissible upper limit of the moiré pitch $P_m$ should preferably be selected equal to the permissible maximum moiré pitch for NTSC system. In other words, for the moiré of the frame for PAL and SECAM system, the following condition should be satisfied for the reason hereinbefore described in conjunction with the formula (15). Namely, $$\frac{P_m}{P_{NTSC}} \leqq 7 \tag{29}$$

wherein $P_{NTSC}$ represents the pitch of the scanning lines of a CPT which is of the same size as those for PAL and SECAM systems and employed in NTSC system. In a similar manner, the following condition has to be valid for the moire of the field for the same reason as described in connection with the equation (27). That is, $$\frac{P_m}{P_{NTSC}} \leqq 14 \tag{30}$$

FIG. 19 illustrates the ranges in which the moire pitches in the frame and the field satisfy the imposed conditions for NTSC, PAL and SECAM systems. The number of traverse bars shown in the drawing indicates the value of n in the regions spanned by tne bar. The oblique line segments represent the region in which different values of n in the adjacent regions give rise to problem.

As can be seen from the drawing, in the case of NTSC system, there are two regions in one of which regions n=2 for the frame and n=1 for the field, while in the other region n=3 for the frame and n=1 for the field. Therefore, when a corresponding value is selected for $P_y$, it is required to make the moire imperceptible at two different values of n. In the case of PAL system, there are two regions in one of which regions n=1 for the field and n=2 for the frame, while in the other region n=1 for the field and n=3 for the frame. The same applies also to the SECAM system. As a value of Δy used in common for n=1 and n=2, numerical example of 0.674 $P_y$ has been described in conjunction with FIG. 12. However, another appropriate value of $\Delta y$ can be used for the case wherein n=1 and n=3 as well as for the case wherein n=2 and n=3. Table V shows combinations of values of n for the field and the frame appearing with respect to each of NTSC, PAL and SECAM systems shown in FIG. 19.

TABLE V

| n | | | | |
|---|---|---|---|---|
| Field | Frame | NTSC | PAL | SECAM |
| 1 | 1 | FIG. 20A Region 80 | FIG. 20B Region 80 | FIG. 20C Region 80 |
| 1 | 2 | FIG. 20A Region 77 | FIG. 20B Region 77 | FIG. 20C Region 77 |
| 1 | 3 | FIG. 20A Region 78 | FIG. 20B Region 78 | FIG. 20C Region 78 |
| 2 | 3 | none | none | FIG. 20C Region 79 |

In correspondence with the Table V, FIG. 20A shows the range of $\Delta y$ and $P_y$ used in common for the combinations of the values of n for the field and the frame generated in the NTSC system. FIGS. 20B and 20C show the range of $\Delta y$ and $P_y$ for the PAL system and the SECAM system, respectively. In these figures, reference numeral 80 denotes the range of $\Delta y$ and $P_y$ usable at n(=1) for both the field and the frame. In the region 77, n=1 for the field and n=2 for the frame. In the region 78, n=1 for the field and n=3 for the frame. In the region 79, n=2 for the field and n=3 for the frame. The oblique lines 50, 52, 53, 55, 56, 58, 61, 62, 64 and 65 represent the boundaries of $\Delta y$ corresponding to the expressions (24), respectively. In this connection, it is to be noted that, since the pitch $P_l$ of the scanning lines is standardized by the pitch $P_{NTSC}$ of the scanning lines in NTSC system, $P_l$ of the equations (24) has to be replaced by $P_{NTSC}$. The shadow mask according to this embodiment of the invention can be used commonly for the various systems in which n takes different values for the field and the frame. The shadow mask according to the invention can be employed in NTSC and PAL systems, in PAL and SECAM systems and in all the NTSC, PAL and SECAM systems. In FIG. 19, reference numerals 74 and 75 denote the ranges in which the shadow mask can be used in both NTSC and PAL systems with n=1 or n=1 and n=2, numerals 76 and 77 denote the ranges in which the shadow mask can be used in both PAL and SECAM systems with n=1 or n=1 and n=2, numerals 78 and 79 denote the range in which the shadow mask can be used in common in NTSC, PAL and SECAM systems with n=1 or alternatively n=1 and n=2. In the range 78, n=1, while in the range 79, n can take the values 1 and 2. As can be seen from FIG. 19, the range in which the shadow mask can be utilized in common for two or three systems correspond to the regions in which n=1 or n=2. When $\Delta y$ is selected equal to 0.674 $P_y$ the above range can be wholly covered.

As will be appreciated from the foregoing description, when $P_l$, n, $P_y$ and $\Delta y$ are maintained in the relations expressed by the equations (12), (12a) and (23) according to the teaching of the invention, the pitch $P_m$ of the moire can be decreased to a minimum and the phase difference between the moirés caused by the aperture transmittivity or through-rate patterns of the adjacent aperture rows can be constrained in the range of 180°±63°, whereby the moiré pattern is considerably suppressed. Furthermore according to the invention, the phase differences of the moirés for n(=1 and 2), n(=1 and 3) and n(=2 and 3) can be constrained within the above range. Thus, one and the same pattern of apertures can be used over a wide range of $P_y$. When $P_y$ is fixed, variation in the pitch $P_l$ of the scanning lines at the center and the peripheral portions of CPT as well as variation of $P_l$ due to poor linearity of the vertical deflection system are permissible. The moiré can be reduced even in the cases in which n=2 for the frame and n=1 for the field. Since the shadow mask according to the invention can be used in common in two or three systems of NTSC, PAL and SECAM, the number of types of CPT's may be advantageously decreased and at the same time the CPT can be manufactured inexpensively. In the above description, it has been assumed that the electron beam transmissive aperture 5 is of a rectangular shape as shown in FIG. 11. However, the invention is not restricted to such shape of the aperture. Rectangular shape having rounded corners, ellipsoid, circle or any other suitable shape may be imparted to the apertures.

What is claimed is:

1. A color picture tube having a shadow mask provided with a plurality of juxtaposed aperture rows each comprising a plurality of apertures aligned with a predetermined pitch $P_y$, wherein among a deviation $\Delta y$ between the apertures of the adjacent aperture rows, a pitch $P_l$ of scanning lines and said pitch $P_y$, there exist the following relations:

$$\frac{(m-0.35)P_y}{2n} \leqq \Delta y \leqq \frac{(m+0.35)P_y}{2n},$$

where n is 1, 2 or 3 and m is a positive odd number smaller than 2n, and $1.17 \leqq P_y/P_l \leqq 1.50$ for $n(=1)$, $1.50 \leqq P_y/P_l \leqq 1.75$ or $2.33 \leqq P_y/P_l \leqq 2.50$ for $n(=2)$, and $2.50 \leqq P_y/P_l \leqq 2.63$ for $n(=3)$.

2. A color picture tube having a shadow mask provided with a plurality of juxtaposed aperture rows each comprising a plurality of apertures aligned with a predetermined pitch $P_y$, wherein among a deviation $\Delta y$ between the apertures of the adjacent aperture rows, a pitch $P_l$ of scanning lines and said pitch $P_y$, there exist the following relations:

(a) when $1.45 \leqq P_y/P_l \leqq 1.56$,
$0.6625\ P_y \leqq \Delta y \leqq 0.675\ P_y$ or
$0.325\ P_y \leqq \Delta y \leqq 0.3375\ P_y$, and
(b) when $2.41 \leqq P_y/P_l \leqq 2.61$,
$0.1625\ P_y \leqq \Delta y \leqq 0.225\ P_y$ or
$0.775\ P_y \leqq \Delta y \leqq 0.8375\ P_y$

3. A color picture tube having a shadow mask provided with a plurality of juxtaposed aperture rows each comprising a plurality of apertures aligned with a predetermined pitch $P_y$, wherein among a deviation $\Delta y$ between the apertures of the adjacent aperture rows, a pitch $P_l$ of scanning lines and said pitch $P_y$, there exist the following relations:

(a) when $1.45 \leqq P_y/P_l \leqq 1.75$ or $2.33 \leqq P_y/P_l \leqq 2.50$,
then, $0.6625\ P_y \leqq \Delta y \leqq 0.675\ P_y$ or
$0.325\ P_y \leqq \Delta y \leqq 0.3375\ P_y$, and
(b) when $2.50 \leqq P_y/P_l \leqq 2.63$, then, $0.442\ P_y \leqq \Delta y \leqq 0.558\ P_y$ 4. A color picture tube having a shadow mask provided with a plurality of juxtaposed aperture rows each comprising a plurality of apertures aligned with a predetermined pitch $P_y$, wherein among said pitch $P_y$, a pitch $P_{NTSC}$ of the scanning lines in an NTSC system and a deviation $\Delta y$ between the apertures of the adjacent aperture rows, there exist the following relations:

$0.6625\ P_y \leqq \Delta y \leqq 0.675\ P_y$ or $0.325\ P_y \leqq \Delta y \leqq 0.3375\ P_y$, and $1.21 \leqq P_y/P_{NTSC} \leqq 1.50$ or $0.95 \leqq P_y/P_{NTSC} \leqq 1.17$ 5. A color picture tube having a shadow mask provided with a plurality of juxtaposed aperture rows each comprising a plurality of aperture aligned with a predetermined pitch $P_y$, wherein among said pitch $P_y$, a pitch $P_{NTSC}$ of the scanning lines in an NTSC system and a deviation $\Delta y$ between apertures of the adjacent aperture rows, there exist the following relations:

$0.6625\ P_y \leqq \Delta y \leqq 0.675\ P_y$ or $0.325\ P_y \leqq \Delta y \leqq 0.3375\ P_y$, and $1.41 \leqq P_y/P_{NTSC} \leqq 1.50$ 6. A color picture tube having a shadow mask provided with a plurality of juxtaposed aperture rows each comprising a plurality of apertures aligned with a predetermined pitch $P_y$, wherein a deviation $\Delta y$ between apertures of the adjacent aperture rows is so selected as to satisfy the following relations:

$0.6625\ P_y \leqq \Delta y \leqq 0.675\ P_y$ or $0.325\ P_y \leqq \Delta y \leqq 0.3375\ P_y$ or $0.1625\ P_y \leqq \Delta y \leqq 0.225\ P_y$ or $0.775\ P_y \leqq \Delta y \leqq 0.8375\ P_y$, and wherein sets of the aperture rows in which every apertures are deviated from corresponding apertures in the adjacent aperture row for the deviation $\Delta y$ with signs (+), (−), (−) and (+) in this order are arrayed in a repeated manner.

7. A color picture tube having a shadow mask provided with a plurality of juxtaposed aperture rows each comprising a plurality of apertures aligned with a predetermined pitch $P_y$, wherein a deviation $\Delta y$ between apertures of the adjacent aperture rows is so selected as to satisfy the following relations:

$0.6625\ P_y \leqq \Delta y \leqq 0.675\ P_y$ or $0.325\ P_y \leqq \Delta y \leqq 0.3375\ P_y$ or $0.1625\ P_y \leqq \Delta y \leqq 0.225\ P_y$ or $0.775\ P_y \leqq \Delta y \leqq 0.8375\ P_y$ or $0.425\ P_y \leqq \Delta y \leqq 0.5583\ P_y$, and wherein sets of the aperture rows in which every apertures are deviated from corresponding apertures in the adjacent aperture row for the deviation $\Delta y$ with signs (+), (+), (−), (+), (−), (−), (−) and (+) in this order are arrayed in a repeated manner.

* * * * *